US005417289A

United States Patent [19]

Carisella

[11] Patent Number: 5,417,289

[45] Date of Patent: May 23, 1995

[54] INFLATABLE PACKER DEVICE INCLUDING LIMITED INITIAL TRAVEL MEANS AND METHOD

[76] Inventor: James V. Carisella, P.O. Box 10498, New Orleans, La. 70181

[21] Appl. No.: 175,607

[22] Filed: Dec. 30, 1993

[51] Int. Cl.[6] ..... E21B 33/12

[52] U.S. Cl. ..... 166/387; 166/120; 166/123; 166/181; 166/187

[58] Field of Search ..... 166/187, 387, 134, 120, 166/181, 182

[56] References Cited

U.S. PATENT DOCUMENTS

| | | | |
|---|---|---|---|
| 3,160,211 | 12/1964 | Malone | 166/187 |
| 3,527,296 | 9/1970 | Malone | 166/122 |
| 3,529,665 | 9/1970 | Malone | 166/264 |
| 3,529,667 | 9/1970 | Malone | 166/315 |
| 3,542,127 | 11/1970 | Malone | 166/122 |
| 3,575,237 | 4/1971 | Malone | 166/152 |
| 3,581,816 | 6/1971 | Malone | 166/187 |
| 3,604,732 | 9/1971 | Malone | 166/187 X |
| 3,606,924 | 9/1971 | Malone | 166/187 |
| 3,776,308 | 12/1973 | Malone | 166/187 |
| 3,837,947 | 9/1974 | Malone | 156/69 |
| 3,899,631 | 8/1975 | Clark | 166/187 X |
| 3,912,014 | 10/1975 | Wetzel | 166/315 |
| 3,941,190 | 3/1976 | Conover | 166/187 |
| 4,316,504 | 2/1982 | Baker et al. | 166/53 |
| 4,320,803 | 3/1982 | Manderscheid | 166/334 |
| 4,349,204 | 9/1982 | Malone | 166/187 X |
| 4,352,394 | 10/1982 | Zehren | 166/106 |
| 4,429,720 | 2/1984 | Beck et al. | 138/97 |
| 4,485,876 | 12/1984 | Speller | 166/373 |
| 4,535,843 | 8/1985 | Jageler | 166/250 |

(List continue on next page.)

FOREIGN PATENT DOCUMENTS

| | | |
|---|---|---|
| 1014065 | 7/1977 | Canada . |
| 1221027 | 4/1987 | Canada . |
| 1257197 | 7/1989 | Canada . |
| 1274721 | 10/1990 | Canada . |
| 2008152 | 10/1990 | Canada . |
| 2230800 | 10/1990 | United Kingdom . |
| 2230805 | 10/1990 | United Kingdom . |
| 2236779 | 4/1991 | United Kingdom . |

OTHER PUBLICATIONS

"New Inflation Testing Packer Improves Testing Capabilities"; Petroleum Society of CIM; Paper No. 79-3-0-08; pp. 1-8; (May 1979) J. Brandell et al.

"Pack/Perf Could Resolve Problem Completions" by J. P. Pitts; Drill Bit; pp. 84 and 85; Apr. 1980.

"Cement-Inflated packer To Make North Sea Debut"; Offshore Drilling Technology; pp. 31, 33; Mar. 1986.

"Advancements In Drill Stem Testing Through The Use Of Annular Pressure Responsive Equipment And Improvements In Open Hole Testing Through Inflatable Packer Systems" by: N. G. Hortman et al; Society of Petroleum Engineers; pp. 729-735 (Mar. 1981).

"New Completion System Eliminates Remedial Squeeze Cementing For Zone Isolation" by: James E. Oliver; Society of Petroleum Engineers of AIME; pp. 101-105 (Mar. 1981).

*Primary Examiner*—Roger J. Schoeppel

*Attorney, Agent, or Firm*—William C. Norvell, Jr.; Jackson & Walker

[57] ABSTRACT

An inflatable packer and a method for its use are provided for introduction into a subterranean well bore on a conduit. A pinch can form in the inflatable elastomeric bladder of the packer during inflation, forming a seal on the central body, which obstructs the effective passage of pressured fluid, thereby obstructing effective inflation and deflation of the bladder. The packer provides a tension means such that, after an initial amount of inflation, a predetermined amount of inflation pressure must be introduced to the bladder before an end of the bladder is released for axial movement relative to the central body, allowing a gap to form between the bladder and the body and a predisposition to radially expand before full inflation, to diminish the bladder's propensity to pinch and seal on the body.

7 Claims, 3 Drawing Sheets

U.S. PATENT DOCUMENTS

| | | | |
|---|---|---|---|
| 4,614,346 | 9/1986 | Ito | 166/187 X |
| 4,655,292 | 4/1987 | Halbardier | 166/387 |
| 4,708,208 | 11/1987 | Halbardier | 166/387 |
| 4,805,699 | 2/1989 | Halbardier | 166/387 |
| 4,832,120 | 5/1989 | Coronado | 166/187 |
| 4,838,349 | 6/1989 | Berzin | 166/187 |
| 4,840,231 | 6/1989 | Berzin et al. | 166/387 |
| 4,928,759 | 5/1990 | Siegfried, II et al. | 166/65.1 |
| 4,934,460 | 6/1990 | Coronado | 166/386 |
| 4,936,387 | 6/1990 | Rubbo | 166/387 |
| 4,941,534 | 7/1990 | Berzin | 166/285 |
| 4,951,747 | 8/1990 | Coronado | 166/187 |
| 4,962,812 | 10/1990 | Berzin | 166/187 |
| 4,962,815 | 10/1990 | Schultz et al. | 166/387 |
| 4,979,570 | 12/1990 | Mody | 166/387 |
| 5,020,600 | 6/1991 | Coronado | 166/387 |
| 5,044,444 | 6/1991 | Coronado | 166/387 |
| 5,101,908 | 4/1992 | Mody | 166/387 |
| 5,109,926 | 5/1992 | Mody et al. | 166/187 |
| 5,133,412 | 7/1992 | Coronado | 166/381 |
| 5,143,154 | 9/1992 | Mody et al. | 166/187 |
| 5,242,019 | 9/1993 | Benker | 166/187 |
| 5,265,679 | 11/1993 | Coronado et al. | 166/324 |

INFLATABLE PACKER DEVICE INCLUDING LIMITED INITIAL TRAVEL MEANS AND METHOD

CROSS REFERENCE TO RELATED APPLICATIONS

This application is generally related in subject matter to the following applications: Ser. No. 08/175,603, filed Dec. 30, 1993 entitled Inflatable Packer Device And Method and Ser. No. 08/175,603, filed Dec. 30, 1993 entitled Programmed Shape Inflatable Packer Device And Method.

BACKGROUND OF THE INVENTION

1. Field of the Invention

The invention relates to an inflatable packer device, such as a packer, bridge plug, or the like, for use in a subterranean well bore, and a method of using same.

2. Description of the Prior Art

Inflatable packers, bridge plugs, and the like have long been utilized in subterranean wells. Such inflatable tools normally comprise an inflatable elastomeric bladder element concentrically disposed around a central body portion, such as a tube or mandrel. A sheath of reinforcing slats or ribs is typically concentrically disposed around the bladder, with a thick-walled elastomeric packing cover concentrically disposed around at least a portion of the sheath, typically a central portion of the sheath. Pressured fluid is communicated from the top of the well or interior of the well bore to the bore of the body and thence through radial passages, or around the exterior of the body, to the interior of the bladder.

Normally, an upper securing means engages the upper end of the inflatable elastomeric bladder and reinforcing sheath, sealably securing the upper end of the bladder relative to the body, while a lower securing means engages the lower end of the bladder and reinforcing sheath, sealably and slidably securing the lower end of the bladder for slidable and sealable movement on the exterior of the body, in response to the inflation forces.

With inflatable packers of this type, it has been observed that the exposed anchor section of the packer inflates prior to the other sections of the packer which are reinforced against expansion by an elastomeric packing cover element. When an exposed portion, such as the exposed anchor section of the bladder, inflates, the lower end of the bladder moves upwards relative to the body, and the exposed portion inflates until it meets the wall of the well bore, which may be cased or uncased. If well bore is uncased, the well bore will have a wall, and if the well bore is cased, the wall of the well bore will be the interior of the casing.

Although not fully understood, as the inflation begins to propagate downward and the reinforced portions of the bladder begin to inflate, the bladder has a propensity to pinch around the exterior of the body, creating a seal that prevents the effective communication of further fluid to the lower portions of the bladder. As the upper portion of the bladder above the seal continues to inflate, a convoluted fold forms in the bladder at the point of the seal, thus entrenching the seal.

The seal prevents or obstructs passage of the pressured fluid, employed for inflating the inflatable bladder, from reaching the lower portions of the bladder. Further, if the bladder is successfully inflated, the convoluted fold often remains in the bladder. During deflation, this fold can similarly pinch and seal around the body, obstructing the communication of fluid out of the lower portions of the bladder and thereby preventing complete deflation of the bladder.

Prior art packer devices have used the concept of shearably anchoring the slidable end of the bladder to the central body, so that the bladder is not free to immediately move axially in response to inflation forces produced by the introduction of pressured fluid to the interior of the bladder. This introduces a tensile load (or "pre-loading"), causing a predisposition to expand into the bladder, sheath, and cover, and also causes an annular gap to form between the interior of the bladder and the exterior of the central body, due to slight inflation of the bladder caused by the introduction of pressured fluid. The bladder is thus predisposed to expand when the amount of pressure in the bladder is achieved to shear the anchoring means, thereafter allowing full radial expansion of the bladder along its axial length. With this annular gap formed and preloading of the bladder, the tendency for the upper portion of the bladder to inflate prior to the lower portions thereof is reduced, thereby reducing the propensity of the bladder to pinch and seal on the body during the earliest stage of inflation. Examples of prior art incorporating such preloading can be found in U.S. Pat. Nos. 4,832,120 and 4,951,747.

Although the prior art methods predispose the bladder and the sheath and cover to inflate or radially expand, the shearable anchoring means allows no axial movement of the slidable end of the bladder until sufficient pressure causes the anchoring means to shear. Because the anchoring means prevents movement of the slidable end of the bladder and thus inflation of the bladder in this initial stage of the introduction of pressured fluid to the interior of the bladder, the amount of pressured fluid that can be introduced into the interior of the bladder is limited, as is the degree of initial inflation of the bladder and, correspondingly, the size of the annular gap formed and the degree of predisposition to expand.

The present invention addresses the pinching and sealing problems set forth above by providing an inflatable packer device and method of use which provides a tension means such as tensile bolts to allow the formation of a greater amount of uniformly distributed initial inflation fluid and the formation of a larger annular gap between the interior of the bladder and the exterior of the body, to further diminish the bladder's propensity to pinch and seal on the body once the tension means is released.

SUMMARY OF THE INVENTION

The present invention provides an inflatable packer device and method of use thereof with the device being introduceable into a subterranean well bore on a conduit, such device being inflatable by pressured fluid communicated to the device from an available source of pressured fluid located at the top of the well, interior of the well bore, or within the device or setting tool introducing the device into the well bore. The well bore may be cased or uncased. If well bore is uncased, the well bore will have a wall, and if the well bore is cased, the wall of the well bore will be the interior of the casing.

The device has a body, with means on its upper end for selective engagement to the conduit. An inflatable elastomeric bladder is concentrically disposed around the exterior of the body, which is selectively movable between deflated and inflated positions, by the application of pressured fluid applied to the interior of the bladder. The pressured fluid is communicated via a fluid transmission means from the source of pressured fluid, either to the bore of the body and thence through radial passages, or around the exterior of the body, and thence to the interior of the bladder. By the application of this pressured fluid, the bladder may be moved between deflated and inflated positions, so that the inflatable packer device may be moved into or out of sealing engagement with the wall of the well bore.

A first securing means engages one end of the bladder for sealably securing the bladder end to the body, while a second securing means engages the other bladder end of the bladder for sealably and slidably securing the other bladder end to the body, so that the second securing means enables the second bladder end to move slidably relative to the body, in response to the inflation or deflation forces.

The second securing means is secured to a limited initial travel means which permits the second bladder end to move a first, limited distance in response to inflation forces, and thereafter secures the bladder end from axial movement in response to inflation forces until a sufficient pressure is reached, at which point the limited initial travel means releases the second securing means and the second bladder end for further travel along the body in response to inflation forces.

Unlike the prior art methods described above, which do not allow an initial degree of inflation of the bladder before the bladder is released, the present invention allows a greater amount of pressured fluid to be introduced into the interior of the bladder, thus allowing a greater degree of initial inflation of the bladder, and also forming a larger annular gap and predisposition to expand. The pressured fluid is also distributed along a greater portion of the interior of the bladder than in the prior art, because of the larger annular gap and because of the increased inflation pressures reached before the bladder is released. In this initial stage of inflation during which the second bladder end is secured from axial movement, the annular gap forms between the interior of the bladder and the exterior of the body, and the bladder is predisposed to radially expand, as heretofore described, thus substantially alleviating the pinching and sealing problems heretofore described.

DESCRIPTION OF THE PREFERRED EMBODIMENTS

Figure 1:
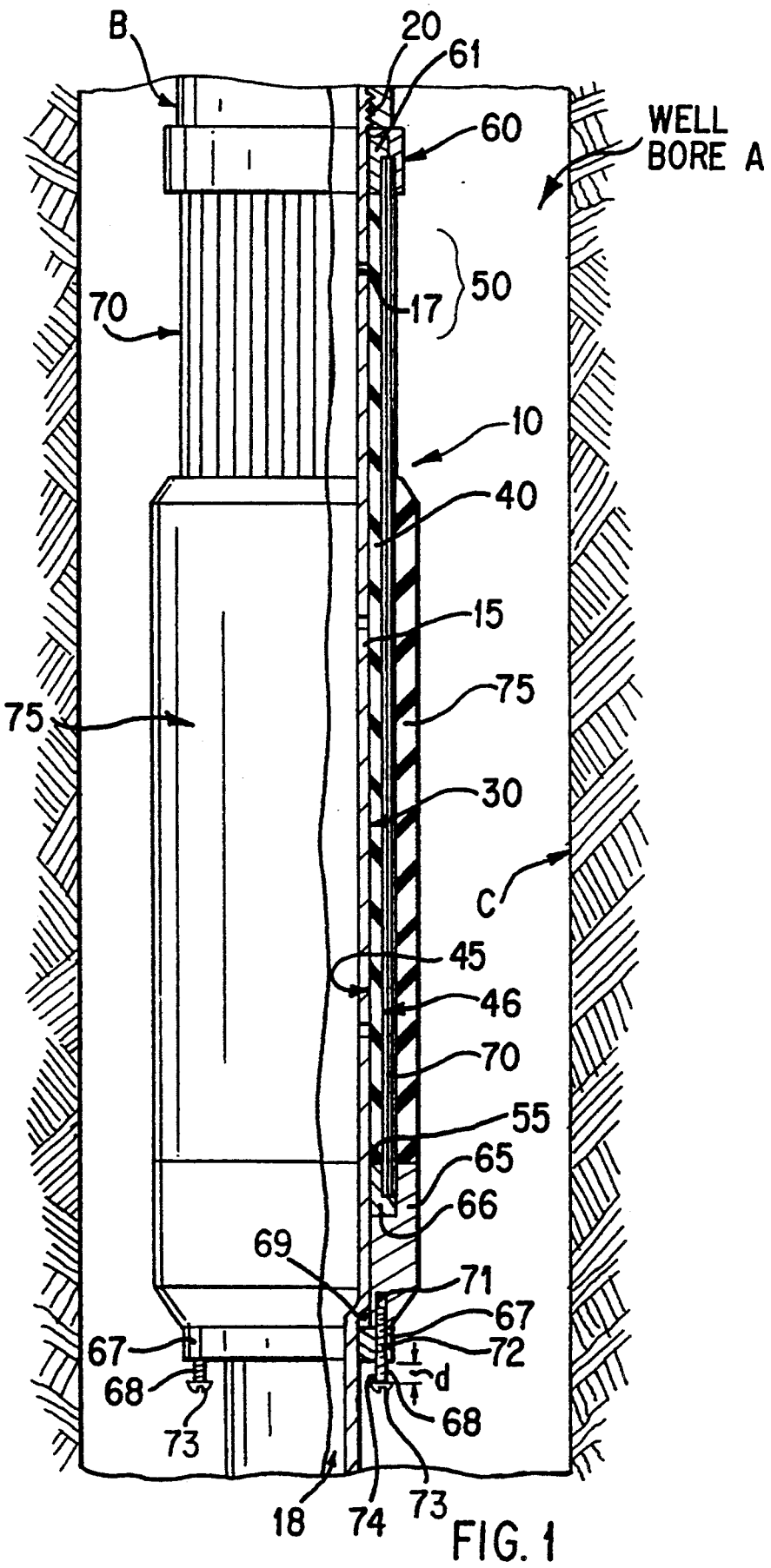
FIG. 1 is a half-sectional elevational view of an inflatable packer device embodying this invention, with the elements of the device shown inserted in a subterranean well bore in their non-inflated positions, prior to actuation for setting in the well bore.

Now referring to FIG. 1, there is shown an inflatable packer device 10. The device 10 may be provided in the form of a packer, bridge plug, tubing hanger, or the like, depending upon whether or not the bore of the device is open or closed.

The packer 10 contains a body 15 which may be provided in the form of a tube. The body 15 extends through the full length of the packer 10 and connects to the bottom of a conduit B, such as tubing in the form of a continuous length coiled tubing, or the like, which extends to the well surface (not shown). The conduit B may also be provided in the form of wire or electric line, or sectioned, threaded drill or production pipe, or casing. The body 15 is connected to the bottom of the conduit B by means on its upper end such as a threaded surface 20 engageable with conduit B.

An inflatable elastomeric bladder 40 is concentrically disposed around the body 15. The bladder may be surrounded and secured relative to a reinforcing sheath 70. The sheath 70 may be formed of a plurality of longitudinally extending slats or ribs with each of the longitudinally extending strips circumferentially overlapping an adjacent strip. The width of such strips and their arrangement in forming the sheath 70 is such that each of the strips will overlap the next adjacent strip when the bladder 40 is deflated and each strip will overlap the next adjacent strip when the inflatable bladder 40 is inflated, thus forming a reinforcing sheath 70 for the inflatable bladder 40 at all times.

The exterior of the reinforcing sheath 70 is either partially or completely surrounded and bonded to an outer annular elastomeric packing cover 75.

The first bladder end 50 and sheath 70 are sealably secured to the body 15 by a first securing means, such as a collar 60 and binding sleeve 61 mounted to the body. The second bladder end 55 and sheath 70 are sealably secured to the body 15 by a second securing means, such as a collar 65 and binding sleeve 66 mounted to the body. The second securing means comprised by the collar 65 and sleeve 66 is also engaged for sealable movement slidably relative to the body 15, in response to the inflation forces.

The bladder 40 is selectively movable between deflated and inflated positions by the introduction of pressured fluid through a fluid transmission means such as the bore 18 and the radial ports 17 in the body 15. The pressured fluid is communicated in a known and conventional manner from the source of pressured fluid (not shown), through the bore 18 and the radial ports 17 to the interior 45 of the bladder 40. Alternatively, the body 15 may be solid, in which case pressured fluid may be introduced around the exterior 30 of the body 15. By the application of pressured fluid to the interior 45 of the bladder 40, the packer 10 may be inflated whereupon the second bladder end 55 and the second securing means comprised by the collar 65 and sleeve 66 move relative to the body and towards the first bladder end 50.

The collar 65 is secured to a limited initial travel means which allows the second bladder end 55, the collar 65, and the sleeve 66 to move towards the first bladder end 50 in response to the application of pressured fluid to the interior 45 of the bladder 40 by only an initial travel distance d in the initial stages of inflation. As shown, the limited initial travel means comprises a ring 67 concentrically disposed around the body 15 and abutting against shoulder 69 in the body 15, and by two screws 68 disposed 180 degrees from one another. The shoulder 69 prevents the ring 67 from moving axially toward the first bladder end 50. Alternatively, the ring may be fixed to the body 15 by any method known to those skilled in the art, such as welding. Although two screws 68 are shown in the embodiment in FIG. 1, any suitable number of screws or similar elements may be used.

The collar 65 is secured to the ring 67 by the screws 68, which are run through bores 72 in ring 67 and threaded into screw receptacles 71 in collar 65. The screws 68 are mounted such that a face 74 the head 73 of each screw 68 is distance d from the ring 67, the distance d typically being between one-eighth of an inch and three-fourths of an inch. However, it will be appreciated by those skilled in the art that the distance selected for d may vary somewhat depending upon a number of factors known to those skilled in the art.

Figure 2:
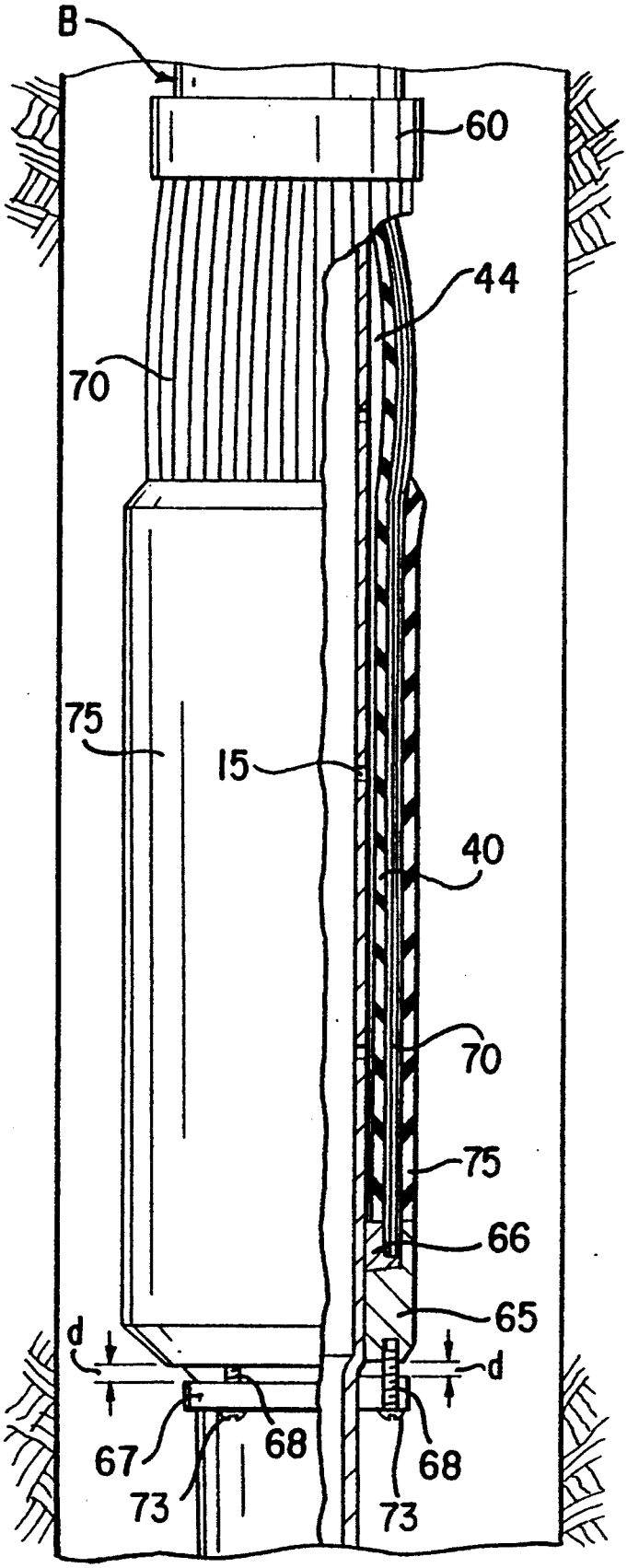
FIG. 2 is a partial half-sectional view similar to that of FIG. 1 showing the inflatable packer device inflated to an intermediate position with the limited initial travel means securing the second bladder end from axial movement.

When pressured fluid is applied to the interior 45 of the bladder 40, the second bladder end 55 and collar 65 are pulled toward the first bladder end 50 due to inflation of the bladder 40. This movement of the collar 65 moves the screws 68 through bores 72 and moves the head 73 of each screw 68 toward the ring 67, until the heads 73 contact the ring 67, as illustrated in FIG. 2, whereupon the movement of the second bladder end 55 towards the first bladder end 50 is temporary terminated and the screws 68 are placed in tension by collar 65. At this point the bladder 40 has inflated an initial amount due to the pressured fluid introduced thereto, creating an annular gap 44 between the interior 45 of the bladder 40 and the exterior 30 of the body 15, and creating in the bladder 40 a predisposition to radially expand. The pressured fluid is also distributed along a the entire length of the interior 45 of the bladder 40 because of the annular gap 44 formed and because of the increased inflation pressures reached before the bladder is released. This intermediate stage of inflation is illustrated in FIG. 2.

Figure 3:
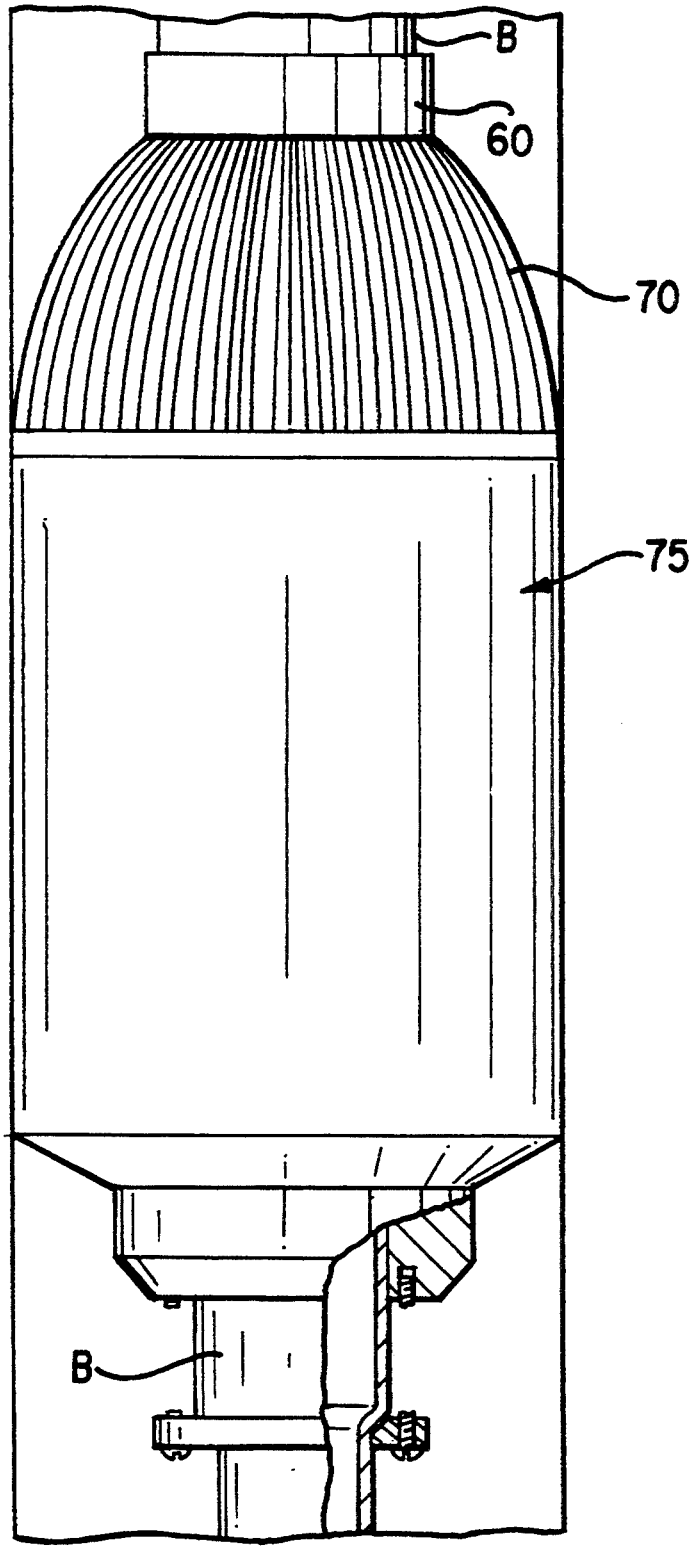
FIG. 3 is a partial half-sectional view similar to that of FIG. 1 showing the inflatable packer device fully inflated and sealingly engaged with the wall of the well bore, subsequent to the release of the second bladder end by the limited initial travel means for further axial movement.

As pressured fluid continues to be introduced into the interior 45 of the bladder 40 the tension on the screws 68 increases until a pre-determined tension is reached, whereupon the screws 68 break, allowing the collar 65 and second bladder end 55 to move toward the first bladder end 50 and allowing the bladder 40 to inflate in response to inflation pressures caused by the pressured fluid. When the bladder 40 once more begins to inflate the pinching and seal problems heretofore discussed are substantially alleviated due to the annular gap 44 that has been created between the interior 45 of the bladder 40 and the exterior 30 of the body 15 and due to the predisposition to radially expand created in the bladder 40. At this point the packer 10 may be further inflated by the introduction of pressured fluid and thus moved into sealing engagement with the casing wall C of well bore A, as illustrated in FIG. 3. The wall of the well bore A may be cased or uncased, and is shown cased with casing C in the figure.

It will be appreciated that alternative embodiments of the invention may employ screws mounted radially that fail shearingly, or similar securing means, or other anchor means that release the second bladder end 55 at some desired magnitude of load. Additionally, in an alternative embodiment the screw heads 73 may initially be in contact with the ring 67, with a distance d between the ring 67 and shoulder 69, such that the entire ring 67 moves through distance d during initial inflation of the bladder 40 until it contacts the shoulder 69.

In operation, the packer 10 is lowered into the top (not shown) of the well bore A on the conduit B to a pre-determinable position. At this position the packer 10 may be moved into sealing engagement with the well bore casing C, as shown in FIG. 3, by the introduction of pressured fluid communicated to the packer 10 from a source of pressured fluid (not shown) located at the top of or within the well bore A. Alternatively, the source of pressured fluid may be located within the device.

After actuation of the packer 10, the packer may be deflated and thereupon removed from the well bore A or moved to a new pre-determinable position within the well bore A for subsequent actuation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packer device for use in a subterranean well bore having a wall and carryable into said well bore on a conduit, said inflatable packer device being inflatable by pressured fluid communicated to the device from a source of pressured fluid, said inflatable packer device comprising:

(a) a body having means on its upper end for selective engagement to said conduit;

(b) an inflatable elastomeric bladder concentrically disposed around said body, said bladder having an interior, the bladder further having a first bladder end and a second bladder end, the bladder further being selectively movable between deflated and inflated positions;

(c) a first securing means engageable with the first bladder end for sealably securing said first bladder end to said body;

(d) a second securing means engageable with the second bladder end for slidably and sealably securing said second bladder end relative to said body;

(e) fluid transmission means for communicating said pressured fluid between the source of pressured fluid and the interior of said bladder to move the bladder between each of deflated and inflated positions, whereby the inflatable packer device may be moved into and out of sealing and unsealing engagement with the well bore wall; and (f) limited initial travel means for selectively engaging the second securing means to said body, whereby first, limited movement of said second securing means in response to inflation pressure produced by said pressured fluid is permitted and, a predetermined amount of pressured fluid is communicated to the interior of said bladder, and further whereby said second securing means is thereafter permitted to disengage from said body and travel toward said first securing means.

2. The inflatable packer device of claim 1 wherein said limited initial travel means comprises a ring carried by said body whereby there is initially provided resistance to relative movement in one direction between said body and said ring, and at least one securing means mounted between said second securing means and said ring, wherein said at least one securing means is mounted for one of tensile or shear failure in response to a pre-determined amount of tension or shear applied through said second securing means.

3. Method of sealing a portion of a subterranean well bore, comprising the steps of:

(a) assembling at the top of the well a conduit having affixed thereon an inflatable packer device carryable into said well bore on a conduit, said well bore having a wall, said inflatable packer device being inflatable by pressured fluid communicated to said device from a source of pressured fluid, said inflatable packer device comprising:

(1) a body having means on its upper end for selective engagement to said conduit;

(2) an inflatable elastomeric bladder concentrically disposed around said body, said bladder having an interior, the bladder further having a first bladder end and a second bladder end, the bladder further being selectively movable between deflated and inflated positions;

(3) a first securing means engageable with the first bladder end for sealably securing said first bladder end to said body;

(4) a second securing means engageable with the second bladder end for slidably and sealably securing said second bladder end relative to said body;

(5) fluid transmission means for communicating said pressured fluid between the source of pressured fluid and the interior of said bladder to move the bladder between each of deflated and inflated positions, whereby the inflatable packer device may be moved into and out of sealing and unsealing engagement with the well bore wall; and (6) limited initial travel means for selectively engaging the second securing means to said body, whereby first, limited movement of said second securing means in response to inflation pressure produced by said pressured fluid is permitted and, a pre-determined amount of pressured fluid is communicated to the interior of said bladder, and further whereby said second securing means is thereafter permitted to disengage from said body and travel toward said first securing means.

(b) running said inflatable packer device on said conduit within said well bore to a predeterminable position within said well bore; and (c) actuating said inflatable packer device by introduction of said pressured fluid to the interior of said bladder, whereby said inflatable packer device moves into sealing engagement with said well bore wall at said position.

4. The method of claim 3 further comprising the step of:

(4) releasing said pressured fluid from the interior of said bladder, whereby said inflatable packer device is removed from sealing engagement with said well bore.

5. The method of claim 3 wherein said limited initial travel means comprises a ring carried by said body whereby there is initially provided resistance to relative movement in one direction between said body and said ring, and at least one securing means mounted between said second securing means and said ring, wherein said at least one securing means is mounted for one of tensile or shear failure in response to a pre-determined amount of tension or shear applied through said second securing means.

6. The method of claim 5 further comprising the step of:

(4) releasing said pressured fluid from the interior of said bladder, whereby said inflatable packer device is removed from sealing engagement with said well bore.

7. The method of claim 4 or 6 further comprising the step of:

(5) moving said inflatable packer device axially within the well bore to a new predeterminable position for further actuating of said device.

* * * * *